United States Patent [19]

Vale

[11] 4,340,064

[45] Jul. 20, 1982

[54] BRASSIERE

[75] Inventor: Peter R. Vale, 1010 Fifth Ave., New York, N.Y. 10028

[73] Assignees: Peter R. Vale; Pearl R. Vale, both of New York, N.Y.

[21] Appl. No.: 99,688

[22] Filed: Dec. 3, 1979

[51] Int. Cl.[3] ..... A41C 3/06

[52] U.S. Cl. ..... 128/496

[58] Field of Search ..... 128/494, 427, 495, 496, 128/497-500

[56] References Cited

U.S. PATENT DOCUMENTS 2,343,476 3/1944 Rosenthal ..... 128/496

3,699,971 10/1972 Hittel et al. ..... 128/498

*Primary Examiner*—Doris L. Troutman

[57] ABSTRACT

A brassiere provides the wearer with a high degree of freedom of movement without irritation to the wearer or displacement of the brassiere from its proper position. The brassiere has cups joined to each other by a Y-shaped insert of two-way stretch fabric. The upper edges of the arms of the insert are free of fabric therebetween, thereby providing additional freedom of movement of the cups relative to each other as the wearer changes position and breathes.

7 Claims, 3 Drawing Figures

BRASSIERE

BACKGROUND OF THE INVENTION

The present invention relates to brassieres and, in particular, to brassieres so constructed as to make it possible for the wearer to engage in vigorous activities without displacing the brassiere from its proper position and without causing irritation to the wearer.

While there are at present known brassiere constructions with the same objectives, such known constructions may be inadequate for achieving the desired results or may not be suitable for figures of all types. Moreover, in the attempt to maintain the brassiere in its proper position, known constructions of brassieres may restrict the degree to which the wearer may move without displacement of the brassiere or causing irritation. The present construction is intended to eliminate such difficulties by providing a brassiere which will remain in position, achieve proper separation, support and shaping of the bust without the danger of displacement or causing irritation to the wearer.

Many types of brassieres have been designed with an elastic fabric disposed between the two cups; the main advantage of such construction is that the elastic expands and contracts as the wearer moves and breathes. Also, there are obvious advantages to forming the inside part of the upper bust cups of elastic and this also has been frequently done in order to give flexibility and accommodation to the various changes in size and position of a women's breast. These desirable objectives were always achieved by joining two or more pieces of elastic either by over-lapping them in the center between the cups or stitching them together at the sides where they form the aforenoted sections. Such constructions have suffered the disadvantage that the act of joining the elastic sections partially defeats the purpose for which they are incorporated. This difficulty arises from the fact that the smooth stretching action is always interrupted at the point or points where the elastic are joined, resulting in various degrees of distortion of the brassiere and of the bust contained within the cups.

SUMMARY OF THE INVENTION

The brassiere of the present invention has a rear releasable fastening means which is adjustable to provide for variation in the chest size of the wearer. For example, a brassiere having a size 34B will, with the construction of the invention, adjust to 34− or 34+. Each of the cups has an upper edge in the shape of an inverted V and a shoulder strap, adjustable in length, connects the ends of the inverted V with the rear fastening means.

A Y-shaped insert of two-way stretch fabric joins the cups; the upper edge of each of the arms of the insert lies along the same line of an upper edge of a cup. Said upper edges are reinforced by a narrow strip of elastic edging. Said Y-shaped insert provides for limited movement of the cups relative to each other, the absence of fabric between the arms of the insert increasing the extent to which the cups may move relative to each other.

Accordingly, a primary object of the present invention is to provide a brassiere which will give the wearer freedom of vigorous movement while at the same time retaining control of the bust.

Another ovject of the present invention is to provide a brassiere construction with self-adjusting separation between the breasts, permitting the brassiere to fit the needs of wearers of different figure types over a range of sizes.

A further object of the present invention is a lightweight, adjustable brassiere which is comfortable and which will give freedom of vigorous body movement without suffering loss of its function of separation, support and shaping.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
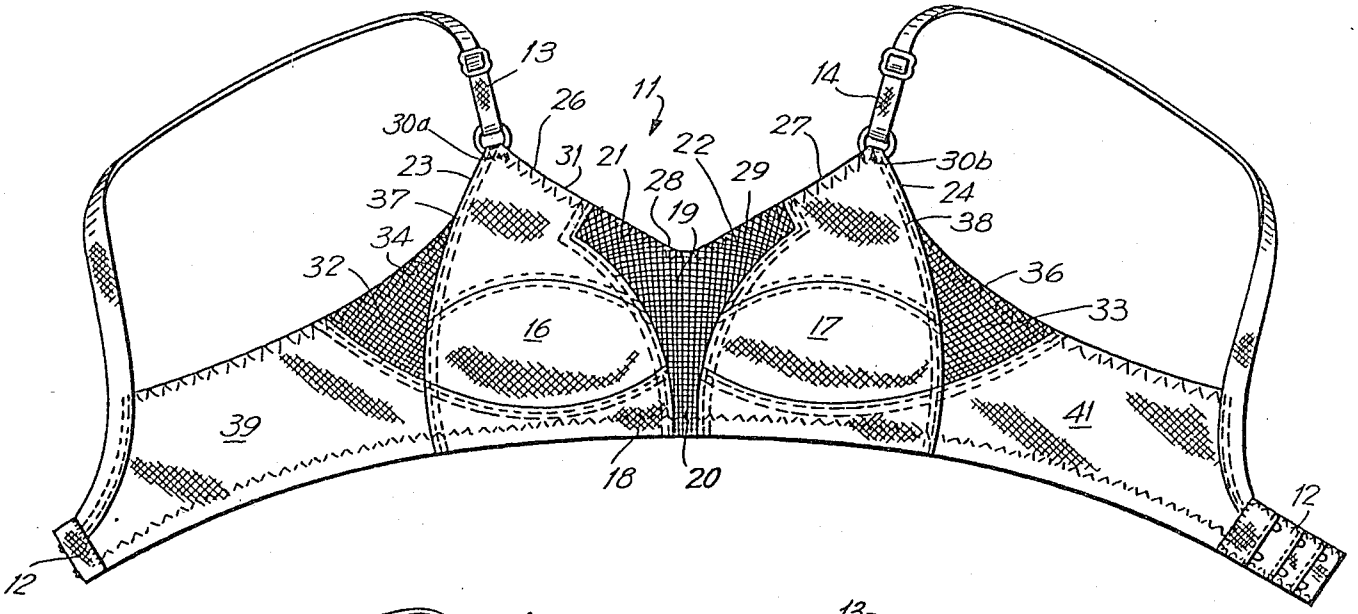
FIG. 1 is a front view of a brassiere in accordance with the present invention.

A brassiere in accordance with the present invention is indicated generally in FIG. 1 by the reference numeral 11, said brassiere having adjustable rear fastening means 12, adjustable shoulder straps 13 and 14, cups 16 and 17 and an underbust band 18 of elastic edging. Cups 16 and 17 are each attached to Y-shaped insert 19 of two-way stretch fabric, said Y-shaped insert having a vertical leg 20, and arms 21 and 22. Said Y-shaped insert provides for suitably restricted displacement of cups 16 and 17 relative to each other, the absence of fabric between arms 21 and 22 of the insert being a significant factor in establishing the degree of relative motion of the cups. This degree of relative motion is such that the wearer of the brassiere can engage in vigorous movement in any direction without displacement of the brassiere from its proper position or loss of support, separation of the bust or the desired shaping of the bust.

The cups themselves are of non-stretch fabric and the upper edges of the cups in the form of inverted V's. Each of the V's has an outer arm indicated by the reference numerals 23 and 24 and an inner arm indicated by the reference numerals 26 and 27. Upper edge 28 of the Y-shaped insert lies along the same line as the upper edge of the inner arm 26 and upper edge 29 of the insert lies along the same line as the upper edge of inner arm 27. This makes it convenient to reinforce edges 26, 28, 29 and 27 with narrow strip 31 of elastic edging. Straps 13 and 14 are each attached at one thereof to a vertex of an inverted V.

Preferably, insert 19 is of lace. The lace normally adds a decorative factor, but is also a means of adjusting the resistance of the insert to motion of the cups 16 and 17 relative to each other. As is evident, the use of openwork lace rather than a tightly-knitted or woven fabric increases the ease of movement of the cups relative to each other.

Each of cups 16 and 17 has attached thereto an insert of two-way stretch fabric in the form of an upright V, the inserts being indicated by the reference numerals 32 and 33. These are also preferably of lace, for the reasons aforenoted. Each of said inserts 32 and 33 has an upper edge on which is a narrow strip of elastic edging, these being indicated by the reference numerals 34 and 36. Elastic edging strips 34 and 36 terminate at intermediate points along outer arms 23 and 24, said intermediate points being indicated by the reference numerals 37 and 38.

Cups 16 and 17 and inserts 32 and 33 are joined to rear fastening means 12 by bands 39 and 41 of two-way stretch fabric. Reinforcing said bands 39 and 41 and the under portions of cups 16 and 17 is said under bust band 18.

Figure 2:
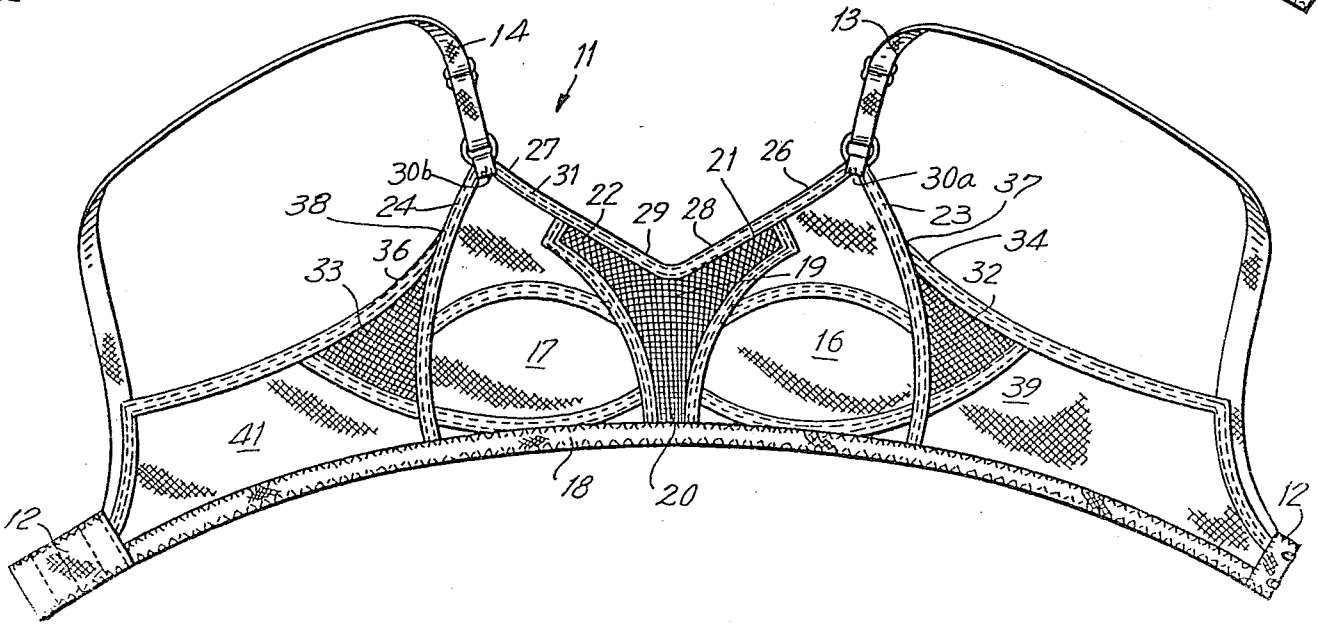
FIG. 2 is a rear view thereof.
Figure 3:
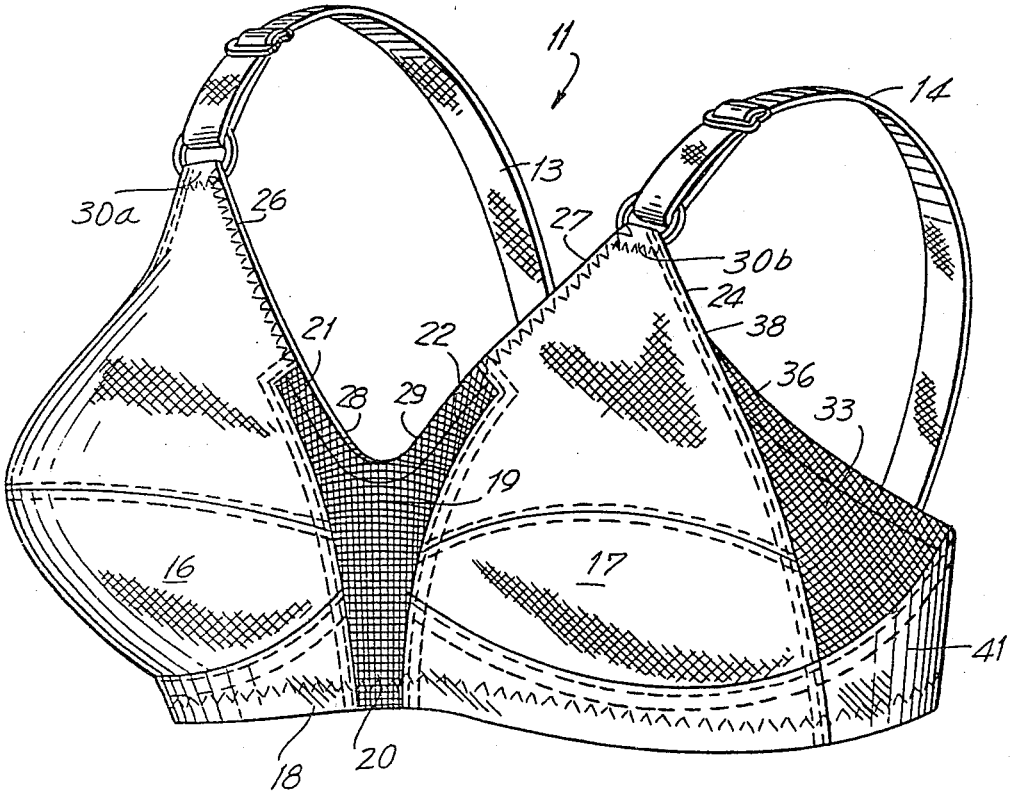
FIG. 3 is a front perspective view of said brassiere.

FIG. 2 is a rear view of the brassiere shown in FIG. 1. As can be seen, the various narrow strips of edging overlie both faces of the fabric of the brassiere. FIG. 3 shows the brassiere of the present invention as it appears in place on the bust of a wearer. The cups 16 and 17 are well separated by Y-shaped insert 19, and arms 21 and 22 while securely fastened to cups 16 and 17 provide for a relative movement of the cups, the degree of relative movement being greater along the upper portion of the bust than between the lower portions thereof.

As will be evident from the Figures and from the above description, the Y-shaped one-piece elastic insert is disposed in the region in which it will have the greatest effect. In addition, since it is of a single piece, the unbroken stretch is transmitted equally in all directions, resulting in a much greater degree of comfort, flexibility and adaptability to changes in size and position of the breast than was previously possible; furthermore, the form if the Y-shaped insert is such that the stretch between the cups is a minimum at the bottom of the insert and increases gradually to a maximum at the upper portion of the insert, the gradation pattern conforming smoothly to changes in size of the chest during breathing and movement of the wearer.

It will thus be seen that the objects set forth above, among those made apparent from the preceding description, are efficiently attained and, since certain changes may be made in the above article without departing from the spirit and scope of the invention, it is intended that all matter contained in the above description and shown in the accompanying drawings shall be interpreted as illustrative and not in a limiting sense.

What is claimed is:

1. In a brassiere including a pair of cups, releasable and adjustable rear fastening means and a pair of shoulder straps, the improvement comprising an upright Y-shaped insert of two-way stretch fabric in a single piece, said insert having side edges joined to each of said cups, said insert providing graduated stretch from a minimum at the bottom of said insert to a maximum at the upper portion of same while providing separation and freedom of motion to the wearer without causing irritation to the wearer.

2. In a brassiere including a pair of cups, releasable and adjustable rear fastening means and a pair of shoulder straps, the improvement comprising an upright Y-shaped insert of two-way stretch fabric in a single piece, said insert having side edges joined to each of said cups, said insert providing graduated stretch from a minimum at the bottom of said insert to a maximum at the upper portion of same while providing separation and freedom of motion to the wearer without causing irritation to the wearer, each of said cups having an upper edge in the form of an inverted V with an inner arm and an outer arm, said inner arms forming an upright V, each of said shoulder straps being joined to the vertex of one of said inverted V's, the upright leg of said Y-shaped insert being disposed between said cups, and the arms of said Y-shaped insert being disposed along said inner arms of said inverted V's so that the upper edges of said arms of said Y-shaped insert and the upper edges of said cups lie along the same lines.

3. The brassiere as claimed in claim 2, further comprising a narrow strip of elastic edging attached to said upper edges for reinforcing same.

4. The brassiere as claimed in claim 2, further comprising V-shaped segments of two-way stretch fabric joining each of said outer arms to said rear fastening means.

5. The brassiere as claimed in claim 4, further comprising additional strips of elastic edging fastened to the upper edges of said rear fastening means and said V-shaped segments, each of said additional narrow strips terminating at an intermediate region along an outer arm of said inverted V's.

6. The brassiere as claimed in claim 1, further comprising an underbust narrow strip of elastic edging fastened to said rear fastening means, said cups and said Y-shaped insert along the lower edges thereof.

7. The brassiere as claimed in claim 2, further comprising an underbust narrow strip of elastic edging fastened to said rear fastening means, said cups and said Y-shaped insert along the lower edges thereof.

* * * * *